United States Patent [19]

Cooper

[11] 4,456,134

[45] Jun. 26, 1984

[54] APPARATUS FOR CONTAINMENT OF CARBONATED BEVERAGES

[76] Inventor: Leonard Cooper, 999 Grant Ave., Pelham Manor, N.Y. 10803

[21] Appl. No.: 341,844

[22] Filed: Jan. 22, 1982

[51] Int. Cl.[3] ..... B65D 21/08

[52] U.S. Cl. ..... 215/12 R; 215/1 C

[58] Field of Search ..... 215/12 R, 1 C; 150/0.5; 222/95, 214, 105

[56] References Cited

U.S. PATENT DOCUMENTS

| | | | |
|---|---|---|---|
| 1,286,875 | 12/1918 | Emerson | 222/95 X |
| 2,685,316 | 8/1954 | Krasno | 150/0.5 |
| 3,021,026 | 2/1962 | Clare | 215/100 A |
| 3,561,644 | 2/1971 | Works | 222/95 |
| 3,912,080 | 10/1975 | Winberg | 206/498 |
| 3,926,341 | 12/1975 | Lhoest | 222/95 |
| 3,938,706 | 2/1976 | Cohen | 222/95 X |
| 3,978,232 | 8/1976 | Dodsworth et al. | 426/115 |
| 4,076,063 | 2/1978 | Cammaratta et al. | 150/0.5 |
| 4,098,434 | 7/1978 | Uhlig | 222/95 X |
| 4,157,103 | 6/1979 | La Fleur | 150/0.5 X |
| 4,207,990 | 6/1980 | Weiler et al. | 220/267 |
| 4,252,256 | 2/1981 | Walsh | 222/211 |

FOREIGN PATENT DOCUMENTS

| | | | |
|---|---|---|---|
| 2355732 | 1/1978 | France | 222/214 |

*Primary Examiner*—Donald F. Norton

*Attorney, Agent, or Firm*—Leonard Cooper

[57] ABSTRACT

A container comprised of a top member having an opening for filling and pouring in the conventional manner and a bottom member integrally connected together by a flexible compressible or collapsible mid-section. Means are also provided for externally connecting between the top and bottom member of the container, which external means operate to alter and maintain the internal volume of the container. Progressive adjustments in internal volume are possible.

19 Claims, 21 Drawing Figures

FIG.5
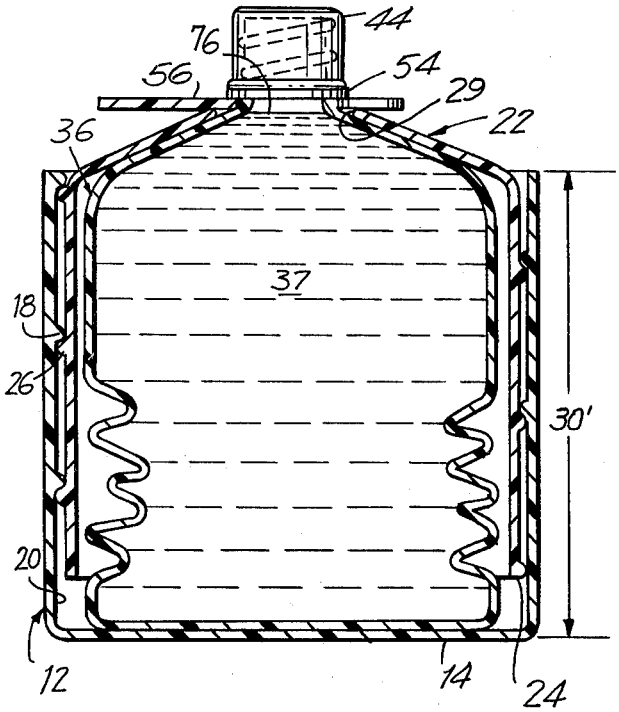
FIG.6
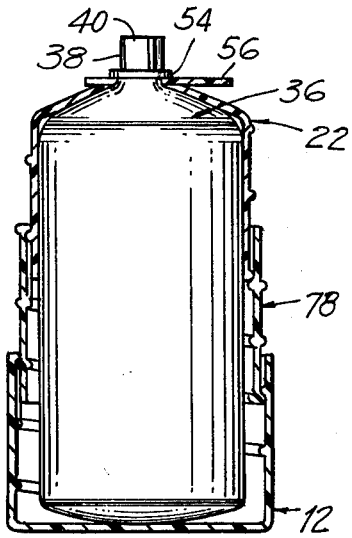
FIG.8
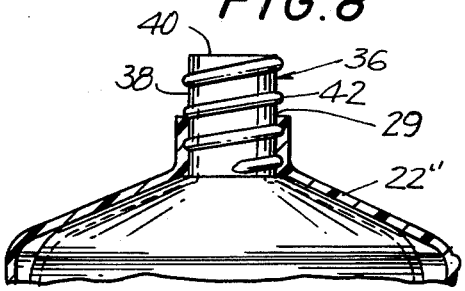
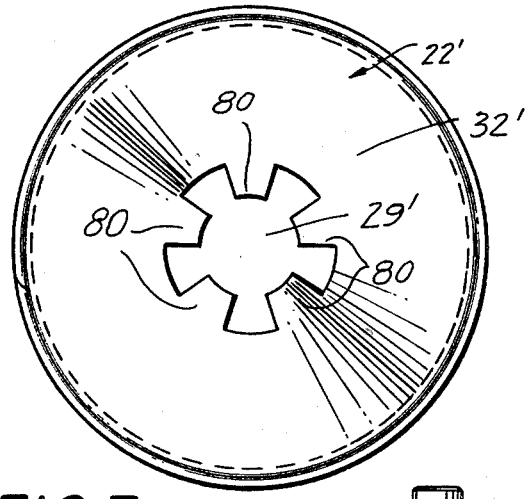
FIG.7
FIG.9d
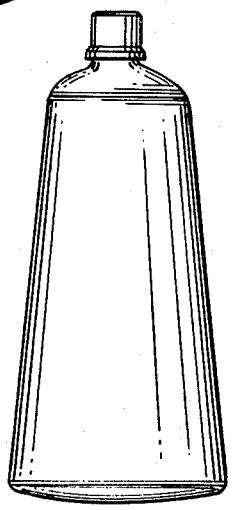
FIG.9a'
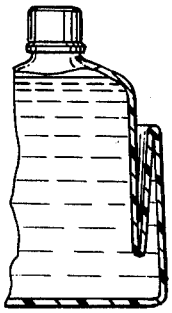
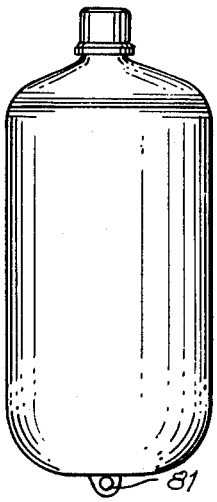
FIG.9a

APPARATUS FOR CONTAINMENT OF CARBONATED BEVERAGES

BACKGROUND OF THE INVENTION

This invention relates to an apparatus for the containment of carbonated beverages, and the like, and more particularly to a variable volume container for such beverages intended to maintain high levels of carbonation in a partially filled container. It is well known that effervescent beverages, such as flavored and unflavored carbonated soda water, beer, sparkling wines, liquid laxatives, etc., tend to lose their carbonation once the container has been opened. The higher is the liquid temperature, the more rapid will be the escape of gas from the liquid. Also, agitation of the liquid tends to accelerate the outflow of gas. After a major portion of gas has escaped from the stored liquid, the beverage has lost its bubbling, fizzy characteristic and is flat. Thus, a most desirable quality of the beverage has been lost.

For this reason, when, for example, a container of soda water has been opened and partially dispensed, it is preferable in attempting to maintain the bubbling characteristic of the remaining portion, to reseal the container opening. For this purpose, the well known screw-type caps with resilient sealing surfaces are provided with many soda bottles. After a portion of soda is poured from the bottle, the cap is replaced and the resealed bottle is generally placed in a refrigerator until the next use. For bottles without screw-type caps there are many well known inexpensive devices which are available for purchase, which serve to reseal, with varying degrees of success, an opened bottle.

Unfortunately, although the bottle has been resealed to prevent spillage or pouring, a quantity of carbonating gas still escapes from the liquid and creates a partial pressure in the space above the liquid. The sealed space above the liquid contains ambient air, which is present when the cap is tightened, and in time, the carbonating gas from the liquid. Other gases may also be present which outgas from the liquid, for example, water vapor. The total pressure within the sealed space above the liquid is the summation of the partial pressures of each gas which is present and is generally higher than room ambient pressure. The pressure of carbonating gas in the space of the liquid is directly related to the liquid temperature. The weight quantity of carbonating gas which escapes the stored liquid to be contained above the liquid is thus dependent at least on the liquid temperature, the carbonating gas temperature and pressure in the space above the liquid, and on the volume of space above the liquid in the container.

When the bottle cap is removed to pour yet another portion of soda water (for example in the following description), the gas above the liquid, including the carbonating gas, is partially or fully vented off to the ambient environment usually before pouring is possible. The effervescent content of the decanted liquid is reduced as compared to the quantity of "fizz" in the earlier poured portion from that bottle. When the container holds a greater volumetric portion of liquid as compared to the volume of gas, that is, when the bottle is more full of liquid than empty, the loss of gas from the liquid during storage between uses is relatively low. But, when the liquid volume remaining in the container is small in amount relative to the volume of the container, that is, when the bottle is nearly empty, the loss of carbonating gas is greater.

Thus, when a container is poured from, and resealed for several use cycles, the amount of gas remaining in each unit volume of liquid for each successive use cycle is less, and the gas loss from the liquid each time the container is resealed is relatively greater. The last drink of carbonated beverage from a large container after several pourings and resealing is frequently entirely flat or has no effervescence shortly after pouring.

Also, the loss problem is aggravated by the trend toward larger and larger bottles of carbonated soda water, with two quart and two liter sizes being quite common and approximate gallon sizes becoming more common. The larger bottles will likely have more pourings with intermittent resealings before they are empty, and in the process offer a greater volume for gas collection over the liquid. Thus, the liklihood of pouring a flat beverage from a larger bottle is increased.

What is needed is a method and apparatus for storing carbonated beverages in the original container without substantial loss in the effervescing qualities of the remaining liquid after a portion of portions of the original carbonated liquid content have been poured out. Also, it is desirable that the apparatus be simple and economical in construction and be reusable or recyclable in whole or in part. Further, the apparatus should be simple and safe to operate.

SUMMARY OF THE INVENTION

Generally speaking, in accordance with the invention, a method and apparatus for containment of carbonated beverages especially suitable for maintaining a high level of carbonation after the bottle has been opened and the contents partially dispensed is provided. In the storage container for carbonated liquids, after a portion of liquid has been poured off, the free volume of the container, where gas released from the liquid may collect, is reduced. When the container is then resealed and maintained in the condition of reduced volume during storage between usage, the gas loss from the liquid is reduced.

The container is comprised of a top member having an opening for filling and pouring in the conventional manner and a bottom member integrally connected together by a flexible compressible or collapsible midsection. Means are also provided for externally connecting between the top and bottom member of the container, which external means, in cooperation withh the liquid remaining in the container operate to alter and maintain the internal volume of the container at several magnitudes. Progressive adjustments in internal volume are possible, as desired.

In one embodiment of an apparatus used in the practice of this invention, the volume of the container is reduced after liquid has been poured off such that an approximate parity is maintained between the volume of the remaining liquid and the volume of the modified container. The container is maintained at a desired reduced size during storage between each usage, and the container is preferably reduced again for storage after each subsequent usage. In addition to preserving the effervescence of the remaining liquid, this embodiment has the obvious advantage of requiring progressively less storage space, for example, in the refrigerator, as compared to the originally full container of this invention, and as compared to the prior art containers which are not modified in volume for storing such beverages.

In an alternative method in accordance with the invention, the space above the liquid is filled with an inert filler material before sealing which material does not appreciably absorb gas or liquid during each storage following pouring from the container. For example, plastic beads, substantially impervious to gas and liquid are submerged in or floating upon the surface of the liquid to serve as the filler.

In another alternative embodiment in accordance with the invention, an expandable container, for example, an inflatable balloon, substantially impervious to the liquid and to the effervescent gas, is placed in the container. After each pouring of liquid from the container, the inner expandable container is further enlarged before the container is sealed for storage. Thus, the free space in the original container of carbonated beverage is reduced.

These embodiments comprising filler materials and inner expanding containers within the outer container are more complex and do not have the advantage of progressively reducing the overall size of the container. Also, provision must be made such that pouring from the container is not disturbed by the inner container or the filler material.

Accordingly, it is an object of this invention to provide an improved method and apparatus for containment of carbonated beverages which reduce the quantity of gas which is lost from the liquid during storage after a portion of the liquid has been removed, for example, by pouring, from the container.

Another object of this invention is to provide an improved method and apparatus for storing carbonated beverages which vary the volume of the container apparatus with simple procedures and construction.

A further object of this invention is to provide an improved apparatus for containment of carbonated beverages which is economical to produce and is at least in part reusable.

Yet another object of this invention is to provide an improved apparatus for containment of volatile materials, whether mixed or combined with other materials, so as to reduce air pollution.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangement of parts which will be adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5 is a view similar to FIG. 1 showing the apparatus of FIG. 1 in a compressed or collapsed state;

FIG. 6 is an alternative embodiment of an apparatus for containment of carbonated beverages in accordance with the invention;

FIGS. 7 and 8 are views of alternative constructions of components usable with the apparatus of FIGS. 1 and 6;

FIGS. 9*a–d* show containers for use with an apparatus in accordance with the invention;

DESCRIPTION OF THE PREFERRED EMBODIMENTS

Figure 1:
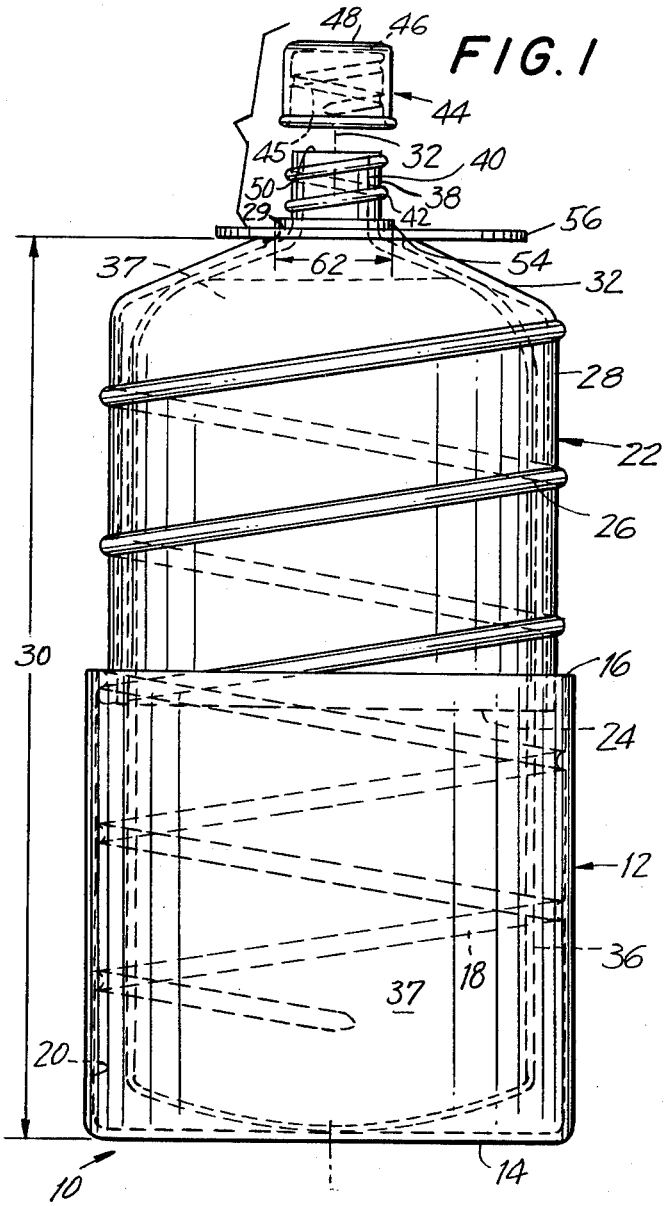
FIG. 1 is an elevational view of a containment apparatus in accordance with the invention.

With reference to FIGS. 1–5, the container apparatus 10, in accordance with this invention, includes a lower generally cylindrical half shell or cup 12, closed at the bottom 14 and open at the top edge 16. A continuous spiral thread 18 is integral with and formed on the inner surface 20 of the lower cup 12. A second or upper shell 22 is generally cylindrical and open at both ends. The lower end 24 of the upper shell 22 telescopes within the lower cup 12, and a continuous spiral thread 26 is integral with and formed on the outer surface of the upper shell 22. The upper shell 22 includes a shoulder 32 which extends inwardly toward an upper opening 29 in the shell 22. The pitch and contours of both spiral threads 18,26 are the same, and one thread engages the other in the known manner such that the shells 12,22 join together (FIG. 1) and the overall length 30 of the two interconnected shells 12,22 is decreased from a maximum engaged length as the shells 12,22 are turned and threaded in one direction relative to each other about their common longitudinal axis 32.

Turning the shells 12,22 relative to each other in the other direction increases the overall length 30 until the two shells 12,22 disengage threads 18,26 and separate one from the other. A minimum overall length 30' (FIG. 5) is achieved when the second shell 22 is threaded down within the lower cup 12 until the lower end 24 of the second shell 22 is positioned substantially against the bottom 14 of the lower cup 12. Intermediate overall lengths 30 are also attained by turning to any stopping point which is intermediate the minimum or maximum overlapped, that is, telescoped positions of the shells 12,22.

A container 36 for holding a pourable material 37, for example, carbonated liquid, is located within the engaged shells 12,22. The container 36 includes a neck 38 with a pour and fill opening 40 at the top. The neck 38 has external threads 42. A cap 44 has internal threads 45 of similar pitch as the neck threads 42, and an internal sealing surface 46 at the top 48 of the cap 44. When closing the container by threading the cap 44 onto the neck 38, in the conventional manner, the sealing surface 46 is compressed against the upper lip 50 of the neck 38 and prevents spillage of liquid and escape of gas from the container 36. The screw cap 44 and its use for closing beverage bottles, for example, containing carbonated soda water, are well known, are not a novel portion of this invention and accordingly, are not described in full detail herein. Similarly, the threading and sealing structure of the neck 38 of the container 36 are well known, are not novel portions of this invention and accordingly, also are not described in full detail herein.

A flange 54 circumscribes the neck 38 and is integral therewith. The neck 38, threads 42 and flange 54 extend without interference through the upper opening 29 in the upper shell 22. A yoke type holding tab 56 substantially encircles the neck 38 at a location below the flange 54. The opening 58 in the holding tab 56, at its greatest transverse width 60, is less than the diameter 62 of the flange 54 and the length 64 of the tab 56 is such that when the neck of the container 38 below the flange 54 is cradled within the tab 56, the holding tab 56 spans the opening 29 in the top of the upper shell 22. Accordingly, when the container 36 is within the upper shell 22 with the neck 38 and flange 54 protruding through the upper opening 29, engagement of the holding tab 56 substantially around the neck, spanning the opening 29 and positioned between the flange 54 and the upper shell 22, prevents the container neck 38 from slipping down through the opening 29.

The width 68 of the tab opening 58 at its narrowest is less than the transverse width 60 which encircles the neck 38 below the flange 54, and presents a slight interference fit with the container diameter when the holding tab 56 is applied as described hereinafter. The holding tab 56 is made of semi-rigid material, e.g., thin metal, plastic, wood, and flexes during application to the container 36 allowing the container neck 38 to pass the narrowest opening 68 in the tab 56 and cradle within the maximum width opening 60. It should be apparent that in an alternative embodiment, the opening 58 and the holding tab 56 may not neck down but may have a uniform maximum width 60, but in such a configuration, the tab 56 is more easily dislodged inadvertently from its desired position (FIG. 1) than is the tab shown in FIGS. 2,3 with an over-center locking effect.

The container 36 for stored liquid is partially rigid and partially flexible. Rigid here defines a material which substantially retains its shape and dimensions and functionability under the forces applied in the usage and practice of the subject invention, for example, having the qualities of a plastic container as is now in conventional use for carbonated beverages. Accordingly, the neck 38, threads 42, flange 54 are rigid and receive the cap 44 and are supported on the upper shell 22 by the holding tab 56, as stated above regardless of changes in shape and volume of the apparatus 10 below the holding tab 56. The container 36 below the flange 54 is at least in part flexible and collapsible along portions of its length as described hereinafter.

Figure 4:
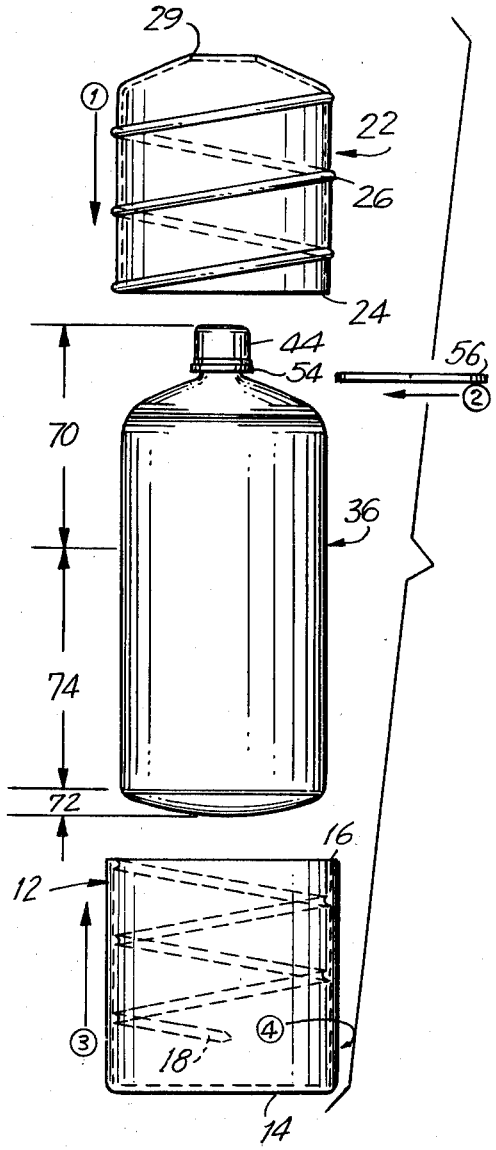
FIG. 4 is an exploded view of the apparatus of FIG. 1 indicating steps for assembly thereof.
Figure 3:
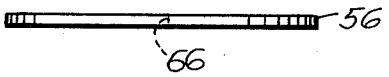
FIGS. 2 and 3 are a top and front view respectively of a component of the apparatus of FIG. 1.
Figure 2:
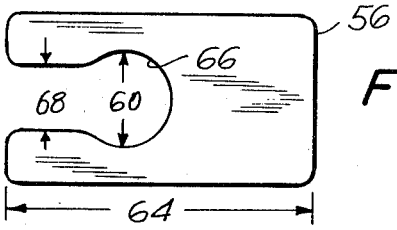

In FIG. 4 a container 36 is shown with a cap 44, having a rigid top section as indicated by the reference numeral 70, and a rigid bottom section as indicated by the reference numeral 72. The intermediate section 74 is flexible and collapsible. In use (FIG. 1) the upper shell 22 is first placed down over the container 36 with the neck 38 and flange 54 protruding through the shell opening 29. Then, the holding tab 56 is slipped transversely beneath the flange 54 to span the top opening 29 in the upper shell 22 as described above. Next, the lower shell 12 is raised upward to receive the container 36 and to telescope with the upper shell 22 until the shell threads 18,26 make contact. Finally, the shells 12,22 are turned relative to each other causing the threads 18,26 to engage and provide a unified, free standing container apparatus 10 (FIG. 1).

After liquid has been dispensed from the container 36 through the opening 40 after the cap 44 has been removed, the shells 12,22 are turned relative to each other, reducing the overall length 30 of the apparatus until the liquid is visible within the container at a level 76 comparable to the level found in the filled container prior to its original opening and usage. Then the cap 44 is reapplied to seal the container 36 for storage until the next pouring is required. In the case of a carbonated beverage, for example, the quantity of gas lost from the liquid is reduced when the container volume is reduced after each use of the container prior to interim storage in a sealed condition. During the interim storage period, the container volume is maintained at its reduced condition. The shells 12,22 may be at least in part transparent or include viewing openings for observing liquid level in the container 36.

FIG. 5 shows the container 36 in its most reduced state, having a length 30' which is approximately one-half of the original length 30. The neck 38 and cap 44 are still exposed such that pouring may be accomplished from the container 36 in the conventional manner even though the size of the container is reduced.

An alternative embodiment of an apparatus for containment of carbonated beverages is illustrated in FIG. 6. The container 36 having a flexible collapsible portion as described above is enclosed within a lower cup 12 having internal threads, an upper shell 22 having external threads and a third cylindrical member 78 having threads on both the inner and outer surfaces. The inner threads of the cylindrical member 78 engage the outer threads of the upper shell 22 and the outer threads of the cylindrical member 78 are in engagement with the inner threads of the lower shell 12. As described with reference to the embodiment of FIG. 1, the container 36 is constrained at the bottle neck 38 by the holding tab 56 which is positioned between the container flange 54 and the upper shell 22. By turning the elements 12, 78, 22 relative to each other in one direction, the container 36 is compressed to reduce the internal volume. This is done incrementally as the beverage is poured from the container 36, prior to each resealing of the open end 40 with the cap 44.

Using the apparatus (FIG. 6), the internal volume of the container can be reduced by a factor of approximately three, that is, the internal volume of the container 36 is reducible incrementally to approximately one-third of the original internal volume. The outer members 12,22,78 of FIGS. 1 and 6 are readily disengaged from the container 36 and are reusable on other similar containers.

As best seen with reference to FIG. 7, the holding tab 56 may be eliminated in an alternative embodiment, by the use of a modified upper shell 22'. The upper shell 22' includes flexible fingers 80 extending from the shoulder 32' toward a central opening 29' through which the neck 38 and the flange 54 are passed when assembling the container 36 within the top member 22'. The diameter of the opening 29' is less than the diameter of the flange 54 on the container 36 such that the fingers 80 on the upper shell 22' are flexed when the shell 22' is forced down over the flange 54. Then the fingers 80 snap in place beneath the flange 54 and prevent the upper shell 22' from being readily moved from the neck of the container 36. In other words, the top portion of the container 36 including the neck 38 cannot slip into the outer container comprised of the elements 12,22', (78) as described with reference to FIGS. 1 and 6. The fingers 80 flex in both directions such that when sufficient downward force is applied on the container 36, the upper shell 22' can be removed from the container neck 38 and is reusable on another similar container 36.

In another alternative embodiment (FIG. 8), an upper shell 22" has internal threads around the top opening 29' which engage with the external threads 42 on the neck 38 of the container 36. The threads 42 on the container 36 may be extended beyond the conventionally threaded length so as to provide proper engagement for a cap 44. Thus, the container 36 is removably connected to the upper shell 22' and a holding tab 56 is not required.

Thus, in every embodiment (FIGS. 1,6,7,8) the container 36 is connected proximate the neck 38 to an upper shell portion of the enclosing structure. Also, it should be apparent that either the upper or lower shell members 12,22 may be telescoped internally or externally of the mating part.

It should be understood that in any alternative embodiment having an upper shell, for example, 22,22', 22", the need for a holding tab 56, fingers 80 (FIG. 7) or threads for engaging the neck 38 (FIG. 8), respectively, are unnecessary where the inner container 36 has sufficient rigidity such that is does not fall through the opening 29 in the upper shell of its own weight. Then the upper shell need only having an opening 29 for the neck 38 and flange 54 such that the shell rests on the shoulder of the container 36.

Figure 9B:
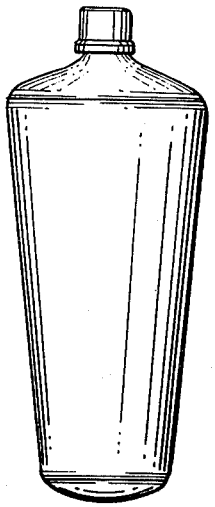
Figure 9B:
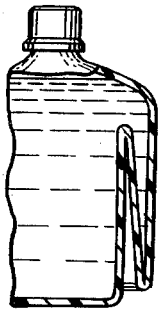
Figure 9C:
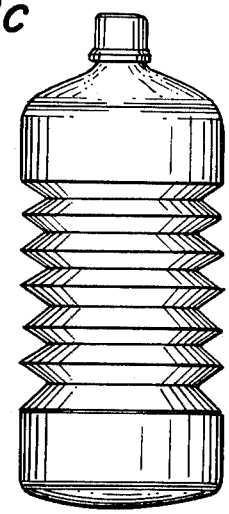

In the above described embodiments, the container 36 is enclosed within a cylindrical structure formed of the upper and lower shells and in the case of FIG. 6 also formed of the intermediate cylindrical portion 78. For this reason the combination of container 36 and outer elements does not rely on rigidity of the container 36 so as to stand upright. The outer shell members 12,22,78 provide rigidity. Therefore, an entirely flexible container 36 can be used which is essentially a bag or a sack, provided with an opening 40 having a rigid neck 38 and flange 54 such that an upper shell 22,22', 22" can be joined to the container as described above. As the external members 12,22,(78) are threaded together to reduce internal volume of the container, the side walls of the container 36 collapse readily. To facilitate this collapse, the flexible container or bag can be cylindrical or formed, for example, so as to taper toward the top, as shown in FIG. 9*a, a'* which illustrates an extended and a partially collapsed continer. Also, the container 36 may be tapered, for example, so as to be narrow at the bottom as illustrated in FIGS. 9*b,b'*. FIG. 9*c* illustrates a readily flexible, compressible or collapsible container 36 having an accordion-like structure such that collapse is produced in an orderly fashion. FIG. 9*d* illustrates a container 36 having a flexible bag construction which is provided with an eyelet 81 connected at the bottom for attachment to the base 14 of the lower shell or cup 12 as explained more fully hereinafter. Thus, containers 36 having basically rigid upper and lower ends, with a flexible collapsible mid-section, can be accommodated by the apparatus in accordance with this invention as well as bag type containers having rigidity only at the upper end for attachment at the neck and flange to the upper shell 22',22" and to provide proper pouring and closure, for example, with a cap 44 such that the container 36 can be filled and poured in the conventional manner. An eyelet 81 can be provided at the bottom of any of the flexible or bag type containers (FIGS. 9*a–d*)

Figure 10:
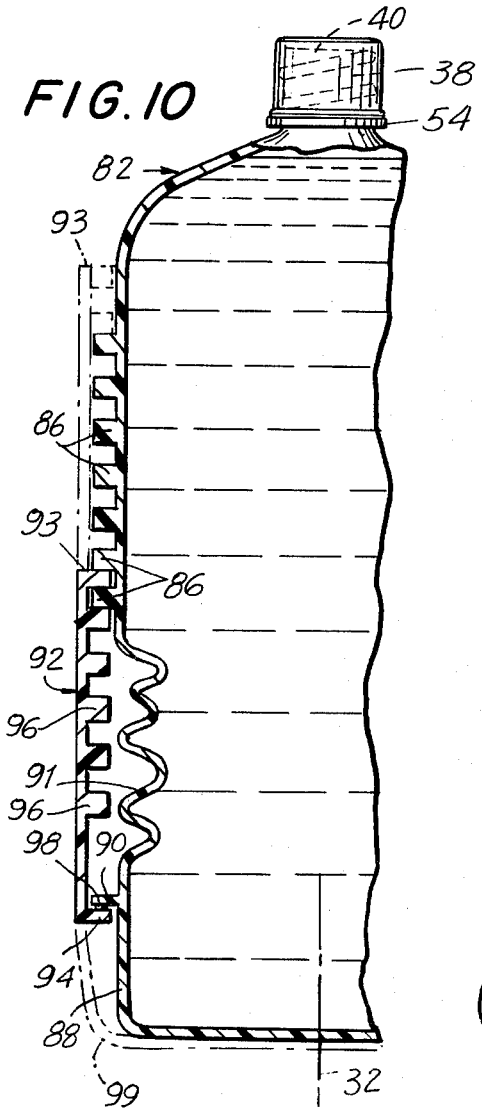
FIG. 10 is a partial elevational view of an alternative embodiment of an apparatus for containment of carbonated beverages in accordance with the invention.

FIG. 10 shows an alternative embodiment of an apparatus for containment of carbonated beverages in accordance with the invention. A container 82 has an upper portion 84 including a neck 38 having external threads and an opening 40 for filling and pouring therefrom and a neck flange 54 as previously described. (Portions of the different embodiments which are the same are given similar reference numerals in the Figures.) The upper portion 84 is relatively rigid and has externally formed threads 86 around the outer circumference. The container 82 also includes a lower portion 88 which is substantially rigid and forms the bottom of the container for holding liquids. A rigid flange 90 encircles the lower portion 88 to give a circular shape to the lower portion 88. Between the upper portion 84 and the lower portion 88 is a flexible collapsible portion 91 of the container 82.

A nut 92, generally cylindrical in shape, is open at both ends. A flange 94 at the lower end of the nut 92 has a diameter such that it provides interference with the flange 90 on the container 82 and rides in sliding contact on the lower surface of the flange 90. The upper end of the nut 92 has internal threads 96 which extend part way down along the inner surface of the nut 92. The internal threads 96 are of the same pitch and contour as the external threads 86 on the upper portion 84 of the container 82. When the nut 92 is turned, engagement is made between the threads 86 on the container and the threads 96 on the nut 92. After the threads 96 have engaged with the threads 86, continued rotation of the nut 92 draws the upper portion 84 of the container 82 toward the lower portion 88 of the container 82 thereby collapsing or compressing together the flexible portion 91 of the container 82. Thus, after each pouring from the container 82 the internal volume of the container can be reduced by rotating the nut 92. A bead 98 on the flange 90 of the container 82, or on the flange 94 of the nut 92 reduces friction when the nut 92 is turned. Reduction in the length of the container 82 can continue until the lower thread 86 makes contact with the flange 90 on the lower portion 88 of the container 82. In so doing, the upper edge 93 of the nut moves beyond the threads 86 to a position as indicated in broken lines. It should be apparent that in an alternative embodiment additional threads 86 may be added to the upper portion 84 extending closer to the neck 38. The threads 96 on the nut 92 need not extend to the flange 94, so long as the number of threads is sufficient to make engagement with the threads 86 regardless of the amount of longitudinal compression of the container 82.

In another alternative embodiment in accordance with the invention, the nut 92 extends around the bottom of the lower portion 88 as indicated with the broken lines identified by the reference numeral 99. In such an embodiment, the flanges 90,94 are not necessary for proper construction and operation of the apparatus. It should also be understood that the nut 92 may have the threads 96 on portions which are fingers (rather than a complete cylinder) extending from the flange 94 such as to produce a castellated effect rather than a complete cylinder having internal threads. This provides flexibility which facilitates removal of the nut 92 for reuse on another container without threading in reverse.

Figure 11:
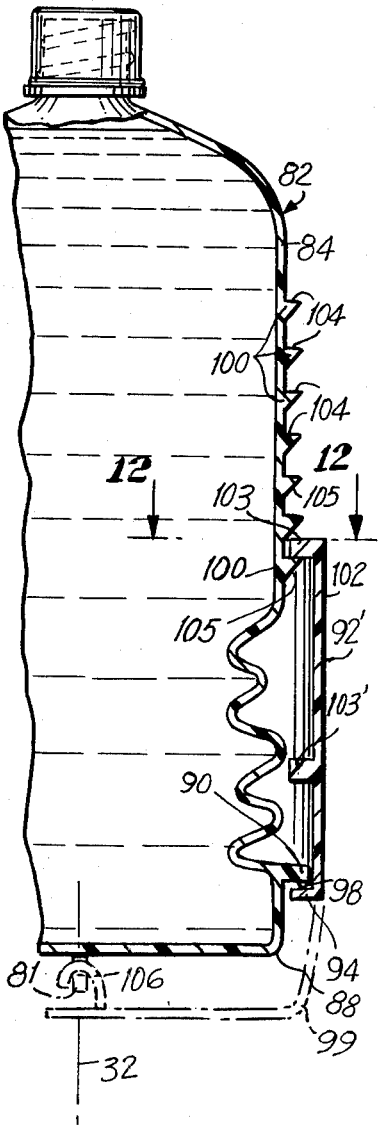
FIG. 11 is a partial view of another alternative embodiment of an apparatus for containment of carbonated beverages in accordance with this invention.

FIG. 11 shows another alternative embodiment of an apparatus for containment of carbonated beverages in accordance with this invention. A container 82 is constructed similarly to the container 82 of FIG. 10, except that the threads 86 are replaced with tapered teeth 100 formed horizontally on the circumference of the upper portion 84. A nut 92' includes a flange 94 engaging the lower surface of a flange 90 on the container 82 as described above. A plurality of pawls 102 extend from the flange 94 on the nut 92' and ends 103 of the pawls 102 rest on the upper horizontal surfaces 104 of the teeth 100. The pawls 102 are resiliently connected to the flange 94, and thus the pawls 92 engage with the teeth 100 on the upper container portion 84 so as to form a linear pawl and ratchet. Thereby, when the nut 92 is pressed toward the neck 38 by compressing container 82, the ends 103 of the pawls 102 slide up the inclined surfaces 105 of the teeth 100 until the pawl 102 is engaged with the next higher tooth 100. Thus, the internal volume of the container 82 is reduced as required, but the ratchet and pawl arrangement prevents return of the container 82 to its original dimensions except when the ends 103 of the pawls 102 are intentionally released from the teeth 100 on the container surface by outwardly flexing the pawls 102.

In an alternative embodiment, the pawls 102 are each fitted with a second end 103' at a lower position along the length of the pawl 102. The second end 103' engages with at least the lower tooth 100 by the time the upper end 103 has disengaged from the upper tooth 100. Thus, compression of the container 82 is achieved beyond the length of the upper portion 84 which has the teeth 100 formed thereon.

Again, it will be understood that in an alternative embodiment, the nut 92' may extend below the bottom of the lower portion 88 of the container 82 as indicated with the broken lines 99, and the need for the flanges 90,94 is eliminated. Because no rotation of the nut 92' is required in the embodiment of FIG. 11 to contract the container 82, the pawls 102 may also be formed as integral extensions from the lower portion 88 of the container 82 or may be locked to the lower position 88 in any suitable manner.

Figure 12:
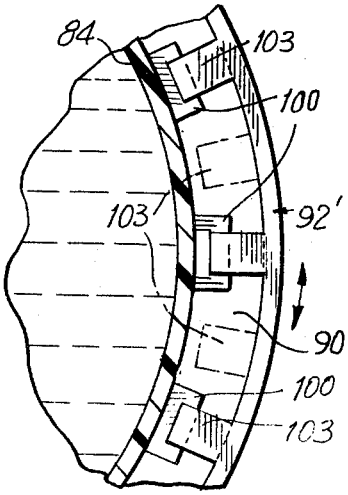
FIG. 12 is a view taken along the line 12—12 of FIG. 11.

Further, in an alternative embodiment in accordance with the invention, (FIG. 12) the teeth 100 are spaced apart around the circumference of the upper portion 84. A slight rotation of the nut 92' places the pawl ends 103 at locations between the teeth 100 as indicated by the broken lines in FIG. 12. In this position, the pawl ends 103 easily slide longitudinally between the teeth 100, and the nut 92' is easily disengaged from the teeth 100 and from the container 82 such that the nut 92' is readily reusable on another container. In the embodiment of FIG. 12, the pawls 102 can be much more rigid than in the embodiment of FIG. 11 and still provide the same level of functionability and reusability. Also, the container can be compressed while the pawls 102,103 are in the broken-line positions of FIG. 12 without flexing the pawls 102. Rotation of the nut 92' to the solid line position, then locks the nut in place.

Because rotation of the container 92 is not required with the embodiments of FIGS. 10,11,12, a hook member 106 shown with broken lines in FIG. 11 may be used to engage any container (FIG. 9*d*, for example) having an eyelet 81 on the bottom. The hook member 106 is attached to a nut 92,92' which extends around the bottom of the container 82 as shown with the broken lines 99 (FIGS. 10,11). Thus, below the lowest tooth 100 on the side wall of the container (FIG. 11), the remaining lower portion of the container 82 can be entirely flexible, for example, a plastic bag having an eyelet 81.

It should be apparent that in alternative embodiments, the threads 86 and teeth 100 which have been illustrated (FIGS. 10,11) on the outer surface of the container top portion 84 may be on the nut element 92,92', and a thread follower and pawls, respectively, may extend down from the container 82 to engage with the threads or teeth on the external surface or the internal surface, of the nut element. Operation similar to a bolt and nut action or a ratchet and pawl action, respectively, is accomplished regardless of the relative positions on the apparatus of the threads/teeth and mating threads/pawls.

Figure 13:
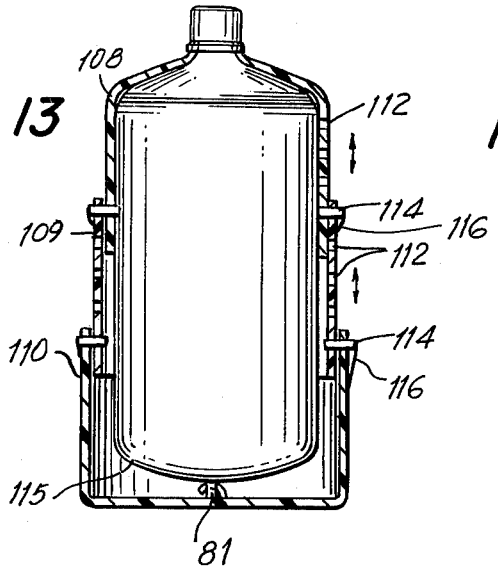
FIGS. 13 and 14 are front and side elevational views of another alternative embodiment of an apparatus for containment of carbonated beverages in accordance with the invention.
Figure 14:
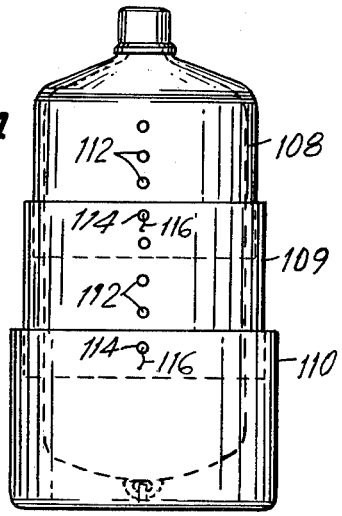

In another alternative embodiment, FIGS. 13 and 14, a compressible container 115 is enclosed within telescoping shells 108-110 having a series of aligned holes 112 spaced along the vertical height. Pegs 114 are pressed through aligned holes between two adjacent shells holding the shells together as an enclosure for the container 115 within. Pegs 114 may be placed in different aligned holes 112 as the shells are telescoped together. Thus, the apparatus can be rigidized at many internal volumes of the enclosed container 115. The neck and cap of the container 115 extend beyond the shell 108 in the manner previously described. Rotation is not required to compress the apparatus and an eyelet construction may be provided at the lower end of the container 115 for engagement with a hook member attached to the base member 110 of the enclosure. The pegs 114 may be flexibly connected by webs 116 to the telescoping members 109,110 and the apparatus is entirely reusable.

In the embodiments described above, the apparatus which controls the volume of the storage container is generally concentric with the container and encloses the container at least in part. In an alternative embodiment of an apparatus for containing carbonated beverages in accordance with the invention (FIG. 15), the apparatus for controlling the internal volume of the container is eccentric with the container. The container 120 has a rigid top portions 121, a rigid bottom portion having a flange 122, and a threaded neck portion 38 and flange 54 are provided for filling and pouring from the container 120 as previously described. Between the flange 54 and the flange 122, the container is at least in part flexible and collapsible so that the container 120 can be compressed longitudinally to reduce its internal volume. A handle assembly 124 engages near the container top below the flange 54 by any suitable construction, e.g., such as shown in FIG. 1, using a tab 56 or using a construction, for example, as shown in FIGS. 7 and 8.

At the bottom, the handle assembly 124 has a circular opening through which the base of the container 120 is passed such that the flange 122 rests against the bottom portion 126 of the handle assembly 124. A vertical cylinder 128 connects to the bottom portion 126 and passes upwardly through the central opening of a fitting 130 attached to an upper portion 132 of the handle assembly 124. The vertical cylinder 128 slides readily through the fitting 130 and a nut 134 sliding on the vertical cylinder 128 engages external threads on the fitting 130. When the nut 134 is tightened onto the fitting 130, the components 128,130,134 compress together with a friction fit such that there is a fixed relationship between these parts. In this condition, the volume of the container is fixed. However, when it is desired to reduce the volume of the container 120, the nut 134 is loosened and the top 121 of the container 120 is pressed down to any desired volume. Then the nut 134 is retightened to hold the container in the reduced volume condition.

Thus, volume adjustment over a wide range of internal volumes is made possible and the vertical cylinder 128 can also be used as a handle as an aid in pouring from the container 120. As the container 120 is pressed, the upper end of the vertical cylinder 128 extends above the fitting 130 as indicated by the broken line.

The containers for holding the liquid may be formed of many materials suitable to the contents of the container. Thus, such plastics as polyethelene, polypropylene, polyvinylchloride, polyester, acrylonitrile and the like can be used for holding liquids. The container may be of one piece or may be fabricated, for example, with reference to FIG. 1 of a rigid top portion 70, a rigid bottom portion 72 with a flexible central collapsible portion 74 bonded to the top and bottom elements to form a unitary container structure which is liquid tight.

The holding tab 56 can be fabricated, for example, of metal, wood, or of plastics mentioned above and as further examples, styrene and nylon. Similarly, the lower cup 12, upper shell 22, cylindrical member 78, nut 92, telescoping shells 108-110, the handle assembly 124, etc. may be made relatively rigidly of the plastic materials described above, yet having sufficient flexibility for proper action of the pawls 102, fingers 80, and the like, as described. The flexible collapsible portions of the containers can include flutes such that the container is compressed like an accordion, or the flexible portion may be essentially a limp bag given shape by the liquid within it. Also, horizontal rings may be combined in the limp bag-like portion such that roundness is provided in the flexible collapsible portion of the container.

The materials which move relative to each other are selected for sliding contact without binding.

Figure 15:
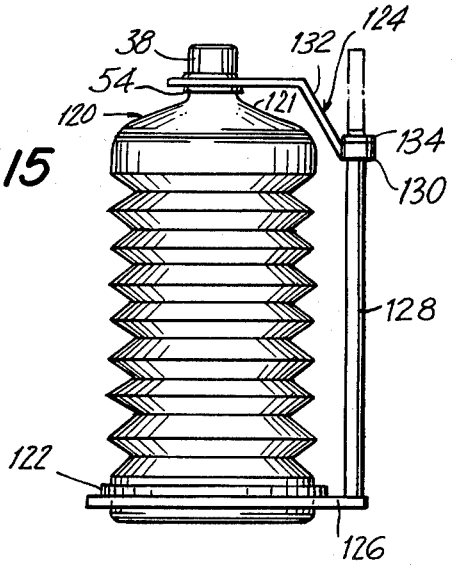
FIG. 15 is another alternative embodiment of an apparatus in accordance with the invention.
Figure 16:
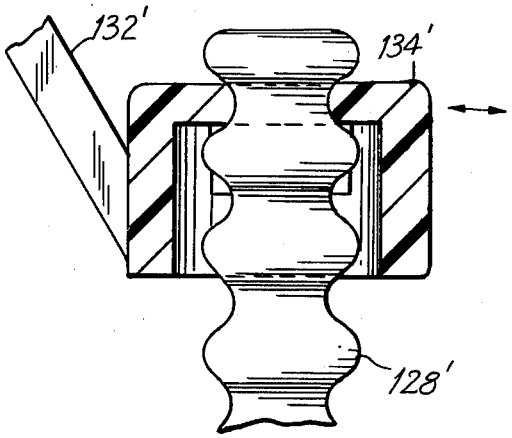
FIG. 16 is a partial view of an alternative apparatus in accordance with the invention.

FIG. 16 is an alternative embodiment in accordance with the invention, similar to the construction of FIG. 15 wherein the vertical cylinder 128' has a wavy surface and the mating nut 134' has flexible castellated fingers (or pawls) which ride on the wavy surface. To compress the container 120, the top of the container is compressed toward the bottom of the container and the vertical wavy cylinder 128' moves upwardly through the nut 134' and is retained at any desired position by a friction grip between the castellated fingers of the nut 134' and the depressions in the vertical cylinder 128. Thus, need for threaded parts such as the nut 134 and the fitting 130 of FIG. 15 is eliminated.

Figure 17:
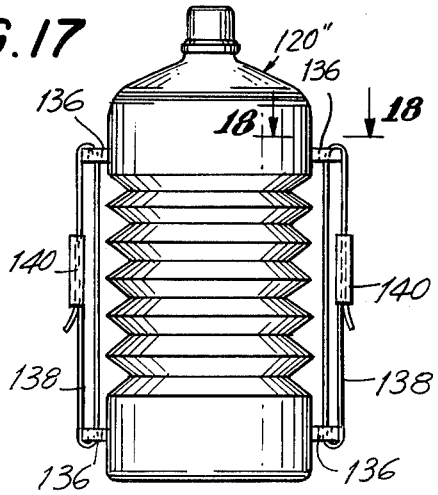
FIG. 17 is an elevational view of an alternative embodiment of an apparatus for containment of carbonated beverages in accordance with the invention.
Figure 18:
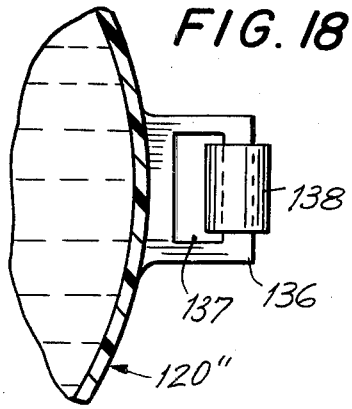
FIG. 18 is a view taken along the line 18—18 of FIG. 17.

In another alternative embodiment (FIG. 17), a container 120' includes grippers 136 located at opposite ends of the central flexible collapsible portion of the container 120'. The grippers 136 have an opening 137 therethrough and a strap 138, which is flexible, is looped longitudinally between two grippers 136 spanning the collapsible portion of the container 120'. The strap is turned around to form a closed loop which is held together by a buckle 140 or any suitable adjustable fastener. In order to compress the container 120', it is only necessary to tighten the strap, that is, reduce the loop to draw the top and bottom of the container 120' together. Two straps 138 attached to the container 120' by means of grippers 136 are illustrated at two diametrically opposed positions but another number of straps, e.g., 3 or 4, may be used. Rigidity of the container 120' alone or with the straps 138 must be provided to maintain the assembly in an acceptable position when the container 120' is full.

It should also be understood that in the embodiments which require no twisting of the adjustable holding means, that is, embodiments using a nut 92' (FIG. 11-16), the container 84,115,120 need not be circular in transverse cross-section but may be, for example, polygonal, square, rectangle, triangle, pentagon, etc. In such embodiments, the opening in the flange 94 (FIG. 11) is contoured to mate with the flange 90 of the container 84 such that the proper holding contact is provided even though the openings may not be identical in contour with the container. With reference to FIGS. 13,14, the outer shells 108,110 need not have the same cross-sectional shape as the container 115. The opening in the bottom portion 126 (FIG. 15) need not have the same contours as the container 120 so long as there is proper engagement between the bottom portion 126 and the flange 122 on the container 120.

Although the embodiments presented above have been described in relationship to liquids containing a gas which causes bubbling, it should be understood that the container of this invention may be suitably used for any contents including pourable solids having a relatively high vapor pressure. The high vapor pressure may be caused by a pure substance stored in the container or by a component of a substance in the container which is volatile and tends to escape, for example, solvents, and the like. These materials build up a vapor pressure of gas in the empty space in the container above the remainder after the container is partially emptied. These gases escape to the ambient atmosphere when the container is opened. In many cases, the gases which escape are undesirable pollutants of the atmosphere and may be dangerous. The amount of such pollutants escaping from the container is reduced when the volume of the container is reduced as the contents, liquid, powder, etc. are dispensed. Thus, an apparatus in accordance with the invention has uses extending beyond the containment of carbonated beverages.

It should also be understood that a handle can be incorporated on either the lower cup 12 or upper shell 22 which serves as an aid in turning these components relative to each other and in lifting the container for pouring.

It should be further understood that the nut 92' of FIG. 11 can be used with an upper shell similar to the shell 22 (FIG. 1), said upper shell having teeth similar to the teeth 100 of FIG. 11 arranged thereon so as to make a container apparatus (not shown) comprised of a nut 92' engaging the bottom portion of the container either by means of a flange similar to the flange 90 of FIG. 11 or by means of a lower cup 99 passing beneath the lower end of the container. Operation is the same as discussed in relation to FIGS. 11 and 12, that is, pushing to compress, and the nut 92' is reusable on other containers.

Whereas the method and apparatus described above rely on a longitudinal compression of the container, it should be understood that the same method can be practiced on apparatus providing for lateral compression or collapsing of the container and then mechanically retaining the sealed container at its reduced volumes during storage between pourings.

It will thus been seen that the objects set forth above, among those made apparent from the preceding description, are efficiently attained and, since certain changes may be made in carrying out the above method and in the constructions set forth without departing from the spirit and scope of the invention, it is intended that all matters contained in the above description and shown in the accompanying drawings shall be interpreted as illustrative and not in a limiting sense.

What is claimed is:

1. A container for storing material therein and having an opening adapted for filling and pouring said material contents, said material including volatile components generating a gas pressure in the portion of said container not filled with said material, said internal pressure exceeding the external ambient pressure, comprising:

a first portion, a second portion, and a third collapsible portion positioned between said first and second portions and joined thereto to form an enclosure for said stored material;

adjustable means for incrementally collapsing said collapsible portion, the internal volume of said container being varied for each incremental adjustment, and for maintaining said container at each condition of adjusted internal volume, the volume of said container being subject to reduction incrementally for storage of said container after portions of said contents are discharged from said opening; and means for sealing said opening against the escape of said internal gas under pressure to said ambient.

2. A container as claimed in claim 1, wherein said internal volume is reduced by reducing the distance between said first and second portions.

3. A container as claimed in claim 2, wherein said adjustable means includes at least two threaded elements, a first said threaded element being connected to said first container portion, a second said threaded element being connected to said second container portion, said at least two threaded elements being threadably engaged, said distance between said first and second portions being adjustable by varying the amount of engagement of said at least two threaded elements.

4. A container as claimed in claim 3, wherein said first threaded element at least in part encloses therein said first portion of said container, and said second threaded element at least in part encloses said second container portion, the combination of said at least two threaded elements, when threadably engaged, enclosing at least in part said third collapsible portion of said container.

5. A container as claimed in claim 3, wherein said first container portion is cylindrical and said first threaded element is formed on the surface of said cylinder, said second threaded element being one of a threaded nut and a threaded shell rotatably engaging said first threaded element.

6. A container as claimed in claim 2, wherein said adjustable means includes at least a tooth on a side surface of said first container portion, and a nut connected to said second container portion, said nut having at least one pawl extending therefrom, one end of said at least one pawl being adapted to selectively and releasably engage said at least one tooth.

7. A container as claimed in claim 6, wherein the number of said teeth is at least two, said teeth being spaced apart longitudinally in the direction of adjusting said distance between said first and second container portions, said one end of said at least one pawl being adapted to releasably engage successive teeth in said longitudinal direction as said distance is reduced, whereby said container is maintainable at a plurality of different internal volumes.

8. A container as claimed in claim 7, wherein said first container portion and said nut are circular, said nut being rotatably connected to said second portion, said teeth being discontinuous around the circumference of said first container portion, rotation of said nut causing said pawl to disengage from said teeth, said disengaged pawl being slidable in said lengthwise direction without tooth engagement.

9. A container as claimed in claim 2, wherein said adjustable means includes at least two telescoping elements, a first said telescoping element being connected to said first container portion, a second said telescoping element being connected to said second container portion, and means for connecting together said telescoping elements with varying amounts of overlap of said telescoping elements, said container internal volume being decreased as the amount of said overlap of said telescoping elements is increased.

10. A container as claimed in claim 9, wherein said means for connecting together said telescoping elements includes holes in said telescoping elements, and pegs removably fitted simultaneously into aligned holes in at least two said telescoping elements.

11. A container as claimed in claim 9 or 10, wherein said first telescoping element at least in part encloses therein said first container portion and said second telescoping element at least in part encloses said second container portion, the combination of said at least two telescoping elements, when connected together, enclosing at least in part said third collapsible container portion.

12. A container as claimed in claim 2, wherein said adjustable means includes a first offset element connected to said first container portion, and a second offset element connected to said second container portion, a third offset element connected between said first and second offset element, means for selectively setting the length of said third offset element between said first and second offset elements, and for releasably holding said selected length, said distance between said first and second container portions being related to said selected length.

13. A container as claimed in claim 12, wherein said third offset element is cylindrical, and said setting and holding means includes a threaded member on one of said first and second offset elements, said cylindrical element passing slidably through said threaded member, and a nut mating with said threaded member, tightening said nut to said threaded member releasably holding the setting of said cylindrical element in said threaded member.

14. A container as claimed in claim 12, wherein said third offset element is a wavy member, one of said first and second offset elements including a portion for releasably engaging said wavy member, said engagement portion being resilient, said wavy member being movable through said resilient portion, the resilience of said portion releasably holding said wavy member at any selected position along the length of said wavy member.

15. A container as claimed in claim 2, and further comprising gripper means connected to said first and to said second container portions, and flexible means extending between said gripper means on said first and second container portions, the length of said flexible means being variable, reducing the length of said flexible means extended between said first and second container portions reducing the internal volume of said container.

16. A container as claimed in claim 15, wherein said flexible means is a strap forming a loop between said grippers on said first and second container portions, said strap being in a closed loop, the length of said strap being maintained at selected values by releasable fastener means.

17. A container as claimed in claim 2, 9 or 12, wherein said second container portion is at least in part collapsible.

18. A container as claimed in claim 17, wherein said second container portion includes an eyelet, and further comprising means for engaging said eyelet, said eyelet engaging means being on said adjustable means for collapsing.

19. A container as claimed in claim 5 or 6, wherein said second container portion includes a flange, said nut being connected to said flange.

* * * * *